US006872058B2

(12) United States Patent
Doig

(10) Patent No.: US 6,872,058 B2
(45) Date of Patent: Mar. 29, 2005

(54) TRAVELLING VOLUME PUMP CHAMBER SURFACE ARRANGEMENT

(76) Inventor: Ian D. Doig, 92 Stingaree Point Dr., Dora Creek New South Wales (AU), 2264

( * ) Notice: Subject to any disclaimer, the term of this patent is extended or adjusted under 35 U.S.C. 154(b) by 181 days.

(21) Appl. No.: 10/381,577

(22) PCT Filed: Sep. 17, 2001

(86) PCT No.: PCT/AU01/01168

§ 371 (c)(1),
(2), (4) Date: Mar. 25, 2003

(87) PCT Pub. No.: WO02/27185

PCT Pub. Date: Apr. 4, 2002

(65) Prior Publication Data

US 2004/0096348 A1 May 20, 2004

(30) Foreign Application Priority Data

Sep. 29, 2000 (AU) ..... PR0534
Nov. 27, 2000 (AU) ..... PR1677

(51) Int. Cl.[7] ..... F04B 43/12
(52) U.S. Cl. ..... 417/477.12; 417/477.4
(58) Field of Search ..... 417/447.1, 477.4, 417/477.12

(56) References Cited

U.S. PATENT DOCUMENTS 2,278,821 A * 4/1942 Bennet et al. ..... 417/477.4
4,102,612 A * 7/1978 Ritter ..... 417/477.12

* cited by examiner

*Primary Examiner*—Michael Koczo
(74) *Attorney, Agent, or Firm*—Coats & Bennett, P.L.L.C.

(57) ABSTRACT

A surface arrangement (30) adapted for use in a travelling volume pump. The pump (50) has a pumping chamber defined between first and second opposed pumping chamber surfaces (52, 54), which extend from an inlet to an outlet of the pump in a pumping direction (58). The surface arrangement (30) includes a plurality of flexible ridges (32) inclined in the pumping direction (58) and forming one or more of the first and second pumping chamber surfaces (52, 54). The ridges (32) span across the one or more pumping chamber surfaces (52, 54) in a direction generally transverse to the pumping direction (58) and have distal peaks (34) adapted to abut and substantially seal against the opposed second pumping chamber surface in the presence of a localised force displacing one of the first or second pumping chamber surfaces (52, 54) towards the other of the first or second pumping chamber surfaces (52, 54).

20 Claims, 12 Drawing Sheets

TRAVELLING VOLUME PUMP CHAMBER SURFACE ARRANGEMENT

This application is a U.S. National Phase application of PCT application PCT/AU01/01168, with an international filing date of Sep. 17, 2001.

FIELD OF THE INVENTION

The present invention relates to a surface arrangement adapted for use in a travelling volume pump (as defined below).

The invention has been primarily developed for use in peristaltic pumps or travelling wave diaphragm pumps. The latter are described in the Applicant's International PCT Patent Application Ser. No. PCT/AU00/01563 (International Publication No. WO 01/50021), the relevant portions of which are hereby incorporated by cross reference. Use of "travelling volume pump" is herein intended to encompass peristaltic pumps and such travelling wave diaphragm pumps.

BACKGROUND OF THE INVENTION

A disadvantage associated with travelling volume pumps is that the effectiveness of the seal between opposed surfaces of the flexible pump tube in a peristaltic pump or between the diaphragm and the pump casing in a travelling wave diaphragm pump, which each form a travelling seal to drive the pumped material in the respective pumps, is related to the mechanical force or pressure applied at the point of sealing. Accordingly, high pumping pressures can only be achieved with high mechanical forces which result in high levels of friction and power consumption.

OBJECT OF THE INVENTION

It is an object of the present invention to substantially overcome or at least ameliorate the disadvantage of the prior art pumps discussed above.

SUMMARY OF THE INVENTION

Accordingly, in a first aspect, the present invention provides a surface arrangement adapted for use in a travelling volume pump, the pump having a pumping chamber defined between first and second opposed pumping chamber surfaces, the pumping chamber surfaces extending from an inlet to an outlet of the pump in a pumping direction, the arrangement including a plurality of flexible ridges inclined in the pumping direction and forming the first pumping chamber surface, the ridges spanning across the first pumping chamber surface in a direction generally transverse to the pumping direction and having distal peaks adapted to abut and substantially seal against the opposed second pumping chamber surface in the presence of a localised force displacing one of the first or second pumping chamber surfaces towards the other of the first or second pumping chamber surfaces.

In a second aspect, the present invention provides a surface arrangement adapted for use in a travelling volume pump, the pump having a pumping chamber defined between first and second opposed pumping chamber surfaces, the pumping chamber surfaces extending from an inlet to an outlet of the pump in a pumping direction, the arrangement including two pluralities of flexible ridges inclined in the pumping direction which respectively form the first and second pumping chamber surfaces, the ridges respectively spanning across said first and second pumping chamber surfaces in a direction generally transverse to the pumping direction and having distal peaks adapted to abut and substantially seal against each other in the presence of a localised force displacing one of the first or second pumping chamber surfaces towards the other of the first or second pumping chamber surfaces.

In a third aspect, the present invention provides a peristaltic or travelling wave diaphragm pump, the pump having:

a pumping chamber defined between first and second opposed pumping chamber surfaces, the pumping chamber surfaces extending from an inlet to an outlet of the pump in a pumping direction; and a plurality of flexible ridges inclined in the pumping direction and forming the first pumping chamber surface, the ridges spanning across the first pumping chamber surface in a direction generally transverse to the pumping direction and having distal peaks adapted to abut and substantially seal against the opposed second pumping chamber surface in the presence of a localised force displacing one of the first or second pumping chamber surfaces towards the other of the first or second pumping chamber surfaces.

In a fourth aspect, the present invention provides a peristaltic or travelling wave diaphragm pump, the pump having:

a pumping chamber defined between first and second opposed pumping chamber surfaces, the pumping chamber surfaces extending from an inlet to an outlet of the pump in a pumping direction; and two pluralities of flexible ridges inclined in the pumping direction which respectively form the first and second pumping chamber surfaces, the ridges respectively spanning across said first and second pumping chamber surfaces in a direction generally transverse to the pumping direction and having distal peaks adapted to abut and substantially seal against each other in the presence of a localised force displacing one of the first or second pumping chamber surfaces towards the other of the first or second pumping chamber surfaces.

The pump according to the third or fourth aspect preferably also includes means to move the application point of the localised force in the pumping direction.

In one form, one of the first or second pumping chamber surfaces is relatively rigid and the other of the first or second pumping chamber surfaces is relatively flexible. In this form, the localised force is applied to the relatively flexible pumping chamber surface.

In another form, both of the first or second pumping chamber surfaces are flexible. In this form, the localised force is applied to both of the pumping chamber surfaces.

Preferably, the ridges have a saw tooth profile in cross section. Desirably, the ridges have sharp peaks, substantially straight sides and are connected by curved valleys.

In an embodiment, at least some of the peaks are bridged by a filtering membrane.

In another embodiment, at least some of the valleys are at least partially filled by deformable sponge material.

In a further embodiment, the first and second pumping chamber surfaces are included in flexible sheets having edges extending parallel to the pumping direction that are substantially sealingly connected to each other, preferably by switching, gluing, welding or the like.

In a yet further embodiment, the first and second pumping chamber surfaces are included in a unitary flexible hollow casing.

BRIEF DESCRIPTION OF THE DRAWINGS

Preferred embodiments of the invention will now be described, by way of examples only, with reference to the accompanying drawings in which.

DETAILED DESCRIPTION OF THE PREFERRED EMBODIMENTS

By way of further background, the flexible pump tube of a peristaltic pump defines a pumping chamber through which the material being pumped travels. Movement in the material occurs when opposed inner surfaces (pumping chamber surfaces) of the pump tube are deformed and relatively displaced, in the presence of a localised force, to close a portion of the pump tube. As the localised force is moved it forms a travelling seal at the point of tube closure which moves from the pump inlet to the pump outlet to drive the material from the inlet towards the outlet.

In one common arrangement, one side of the pump tube abuts a rigid pump chamber wall and the other is displaced towards it by a roller. Alternatively, both sides of the pump tube can be simultaneously subjected to the localised force by a pair of opposed rollers to displace them into closing the tube. In the former, the inner surface of the pump tube and the inner surface of the pump chamber shall hereinafter be referred to as first and second pumping chamber surfaces. In the latter, the inner surface of opposed sides of the pump tube shall be referred to as first and second pumping chamber surfaces.

In relation to a travelling wave diaphragm pump, the first and second pumping chamber surfaces are constituted by the inner surface of the generally sinusoidal flexible diaphragm and the inner surface of the pump chamber that the peaks of the diaphragm seal against to form the travelling seal.

Figure 1:
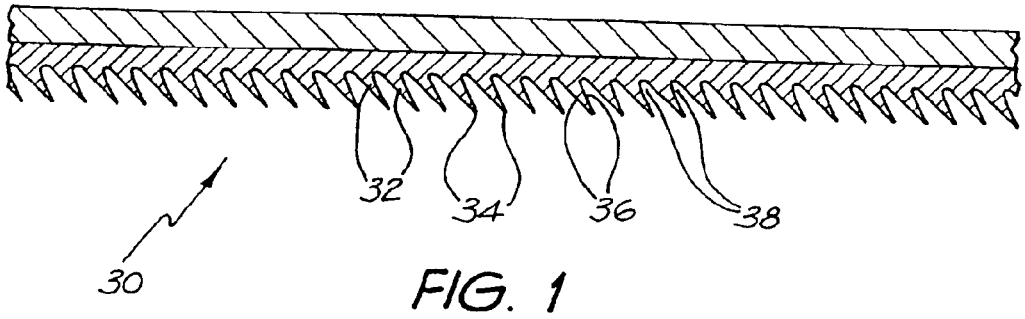
FIG. 1 is a schematic cross sectional side view of a first embodiment of a surface arrangement according to the invention.

FIG. 1 shows a first embodiment of a surface arrangement 30 suitable for use on a (first) pumping chamber surface of a travelling volume pump (as hereinbefore defined). The arrangement 30 includes a plurality of generally triangular shaped ridges 32 having sharp peaks 34 and substantially straight sides 36 connected by curved valleys 38. The ridges 32 are preferably inclined between 20° and 80°, most preferably between 40° and 55°, in the direction in which the material is pumped, the purpose of which will be explained in more detail below. The ridges for 32 are preferably formed in a sheet of elastomeric material, most preferably a flexible fatigue resistant material like polypropylene, and extend across the width of the pumping chamber surface.

Figure 2:
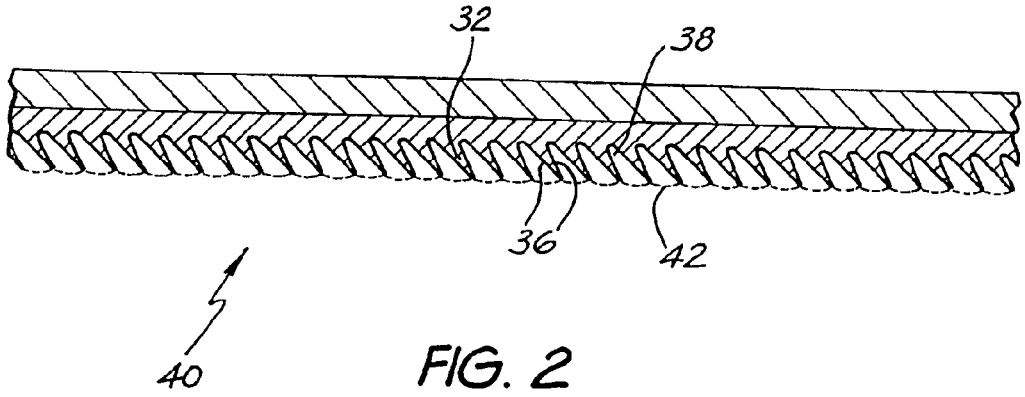
FIG. 2 is a schematic cross sectional side view of a second embodiment of a surface arrangement according to the invention.

FIG. 2 shows a second embodiment of surface arrangement 40 according to the invention, in which like reference numerals have been used to indicate features in common with the first embodiment of surface arrangement 30 shown in FIG. 1. The surface arrangement 40 shown in FIG. 2 also includes a filtering membrane 42 bridging the peaks 34 of the ridges 32, which serves to limit the size of any suspended solids in the material being pumped which could enter the gaps between the ridges 32. The membrane is a porous membrane, preferably made from a flexible fatigue resistant material like polypropylene, which is securely attached at intervals to each or some of the peaks. The membrane 42 also serves to allow liquid being pumped to enter and leave the valleys 38 but prevents all but the finest solids from entering and accumulating in the valleys 38. The attachment at intervals to each or some of the peaks 34 allows liquid to pass from one valley 38 to its neighbouring valley 38 between the peaks 34 and the membrane 42 when the ridges 32 are not being deformed to form a seal.

Figure 3:
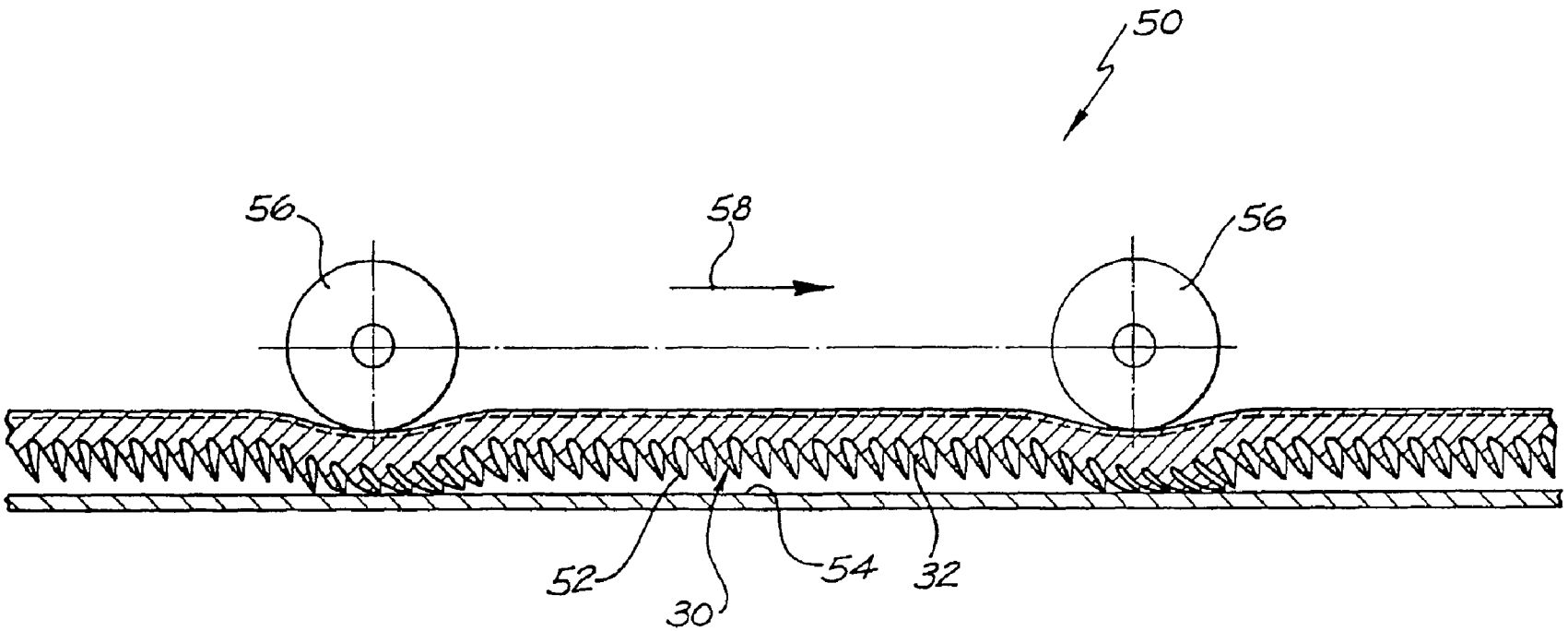
FIG. 3 is a schematic cross sectional side view of a first embodiment of a peristaltic pump according to the invention.

FIG. 3 shows a first embodiment of a peristaltic pump 50, which has a first pumping chamber surface 52, constituted by a surface arrangement 30 identical to that shown and described with reference to FIG. 1, a second pumping chamber surface 54 constituted by a rigid surface, and a pair of rollers 56.

Figure 4:
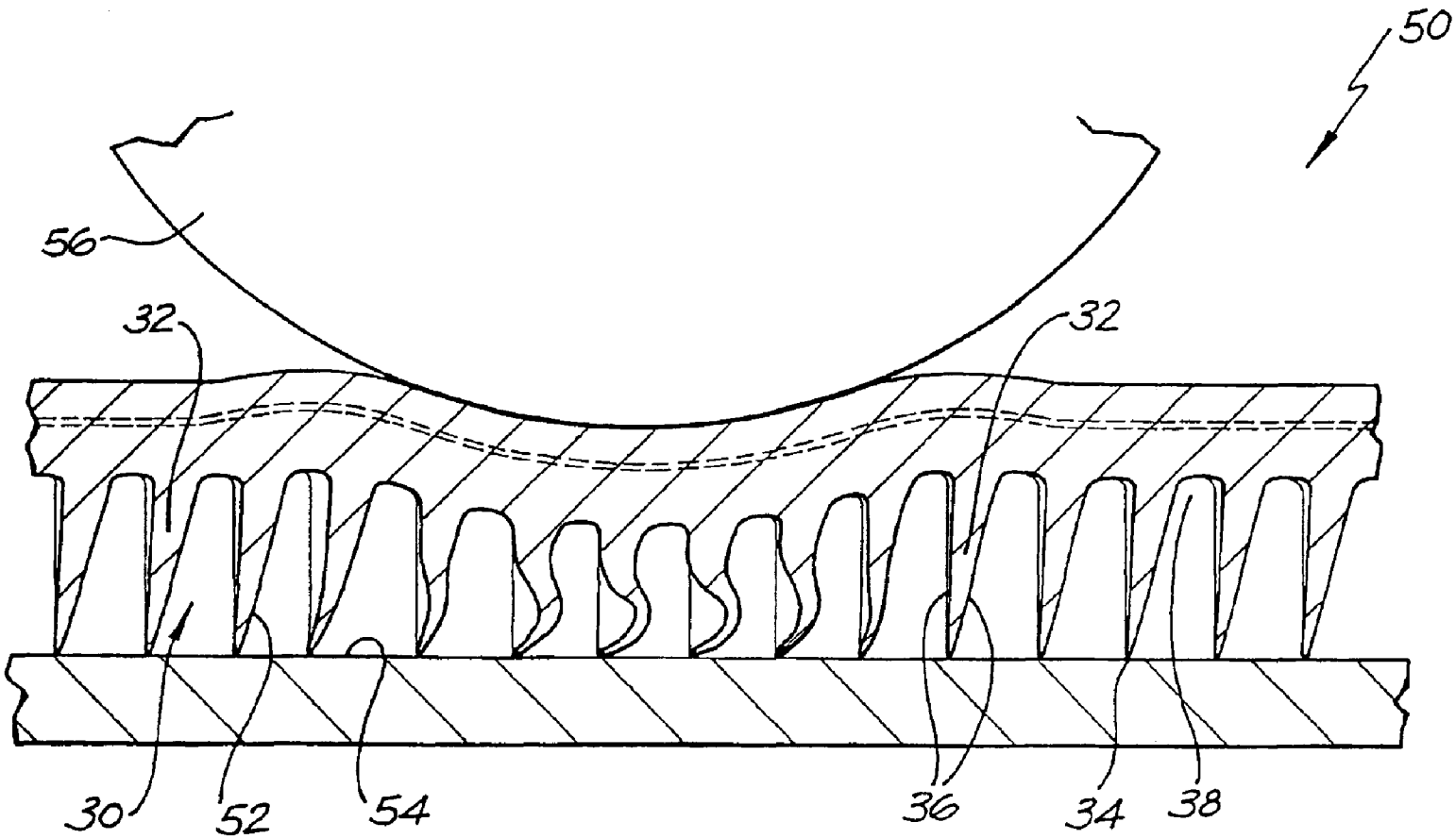
FIG. 4 is an enlarged detail schematic cross sectional side view of the pump shown in FIG. 3.

As is well understood by persons skilled in art, when the rollers 56 are advanced in the direction of arrow 58, the material located between the pumping chamber surfaces 52 and 54, in front of the rollers 56, is caused to advance in that direction. More particularly, and as is best shown in FIG. 4, the rollers 56 apply a localised force which displaces the first pumping chamber surface 52, that includes the ridges 32, towards the second pumping chamber rigid surface 54 to form a travelling seal therebetween. The angled nature of the ridges 32 causes them to deform into a more angled orientation in which they effectively form flap-type one-way non-return valves between the two pumping chamber surfaces 52 and 54. Some sliding off the peaks 34 of the ridges 32 relative to the second pumping chamber surface 54 can also occur depending on the amount of displacement between the first and second pumping chamber surfaces 52 and 54. The natural resilience of the ridges 32 in the absence of the localised force (ie the rollers 56) returns them to an uncompressed configuration in which they do not form a seal against the second pumping chamber surface 54. The forming of flap-type non-return valves in the presence of the rollers 56 is advantageous as the compression force needed to form the travelling seal/valve does not have to exceed that required to sustain the pressure difference upstream and downstream of the roller 56 and is thus considerably less than the mechanical sealing force required in prior art arrangements. Accordingly, pumping is more efficient in terms of: reducing frictional losses; reducing the required deformation force from the rollers; and minimising power consumption.

Figure 5:
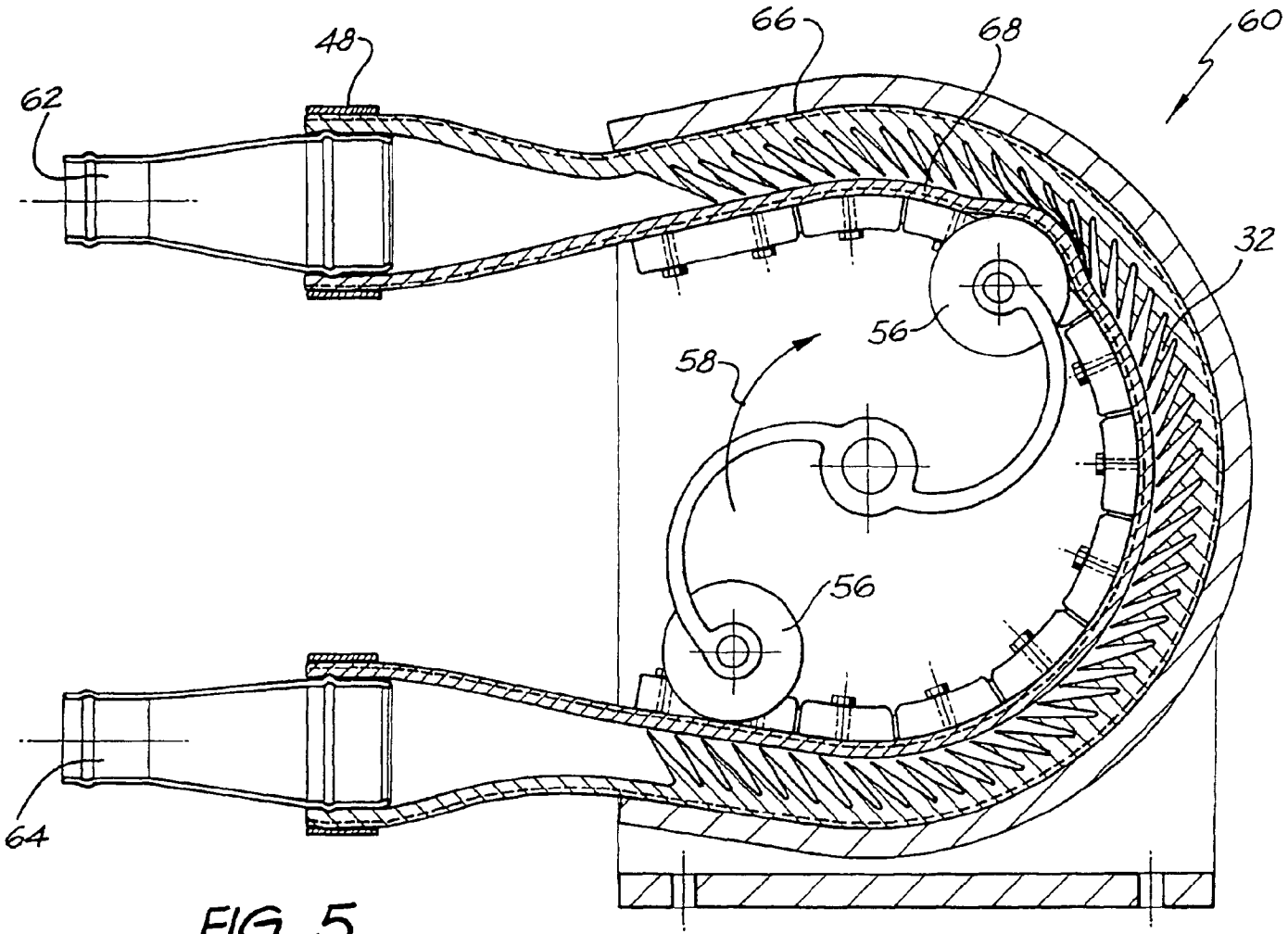
FIG. 5 is a cross sectional schematic side view of a second embodiment of a peristaltic pump according to the invention.

FIG. 5 shows a second embodiment of peristaltic pump 60 in which like features to those shown in earlier embodiments have been denoted by like reference numerals. The pump 60 has an inlet 62, an outlet 64 and a pair of rollers 56 driven in a circular motion in the direction of arrow 58. In this embodiment, the surface arrangement 30 is applied to the inner surface of a rigid arcuate pump chamber body 66, which thus constitutes one of the (first) pumping chamber surfaces. A flexible inner surface 68 forms the other (second) pumping chamber surface, which is deformed by the rollers 56 in a manner similar to that described with reference to the embodiment shown in FIG. 3.

Figure 6:
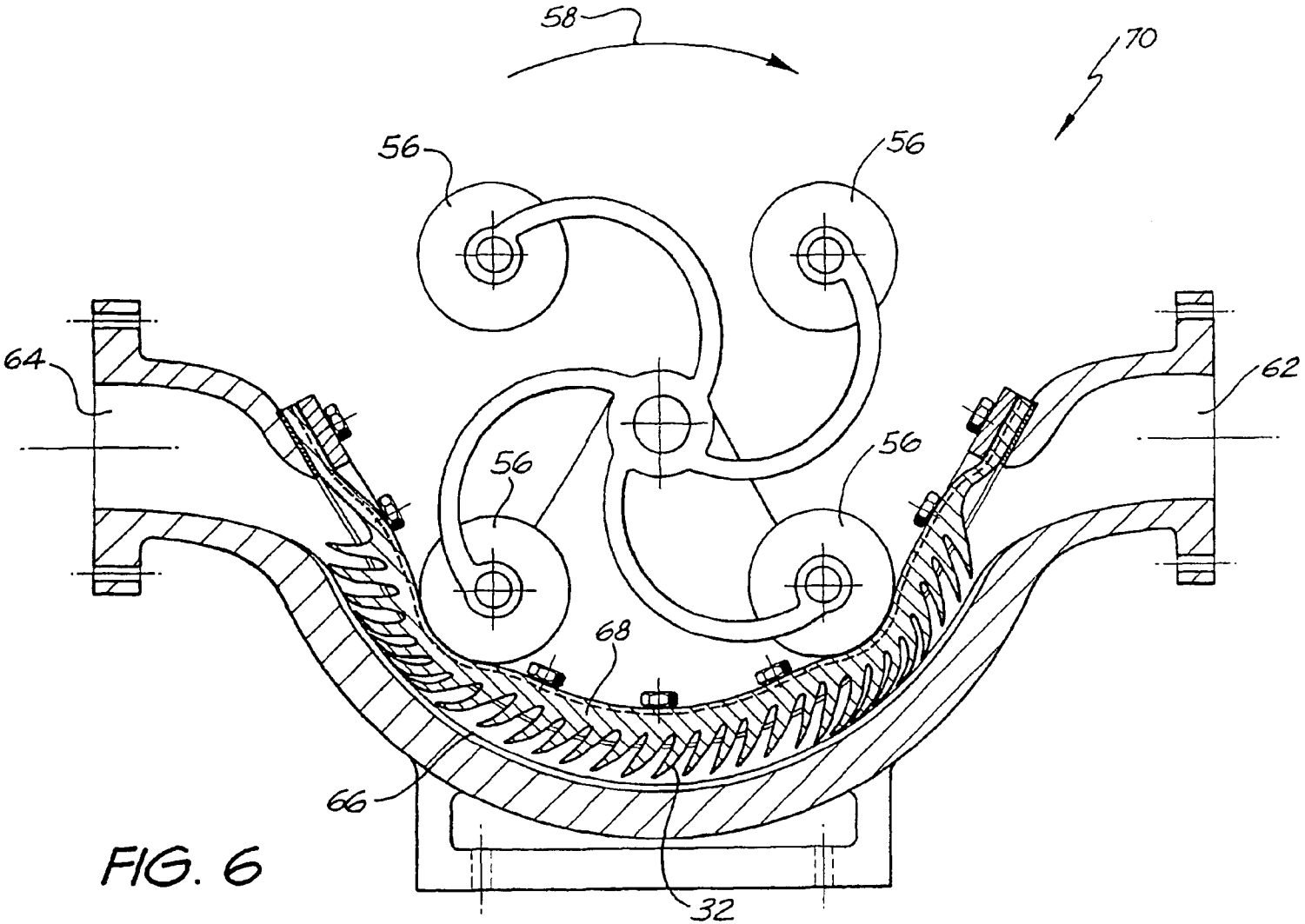
FIG. 6 is a schematic cross sectional side view of a third embodiment of a peristaltic pump according to the invention.

FIG. 6 shows a third embodiment of peristaltic pump 70 in which like reference numerals have again been used to indicate like features from earlier embodiments. The arrangement of the pumping chamber surfaces in the pump 70 is essentially the reverse of that in the pump 60, in that the outer surface of the pump casing 66 is rigid and the inner flexible pumping chamber surface 68 includes the ridges 32 and is displaced by the rollers 56.

Figure 7:
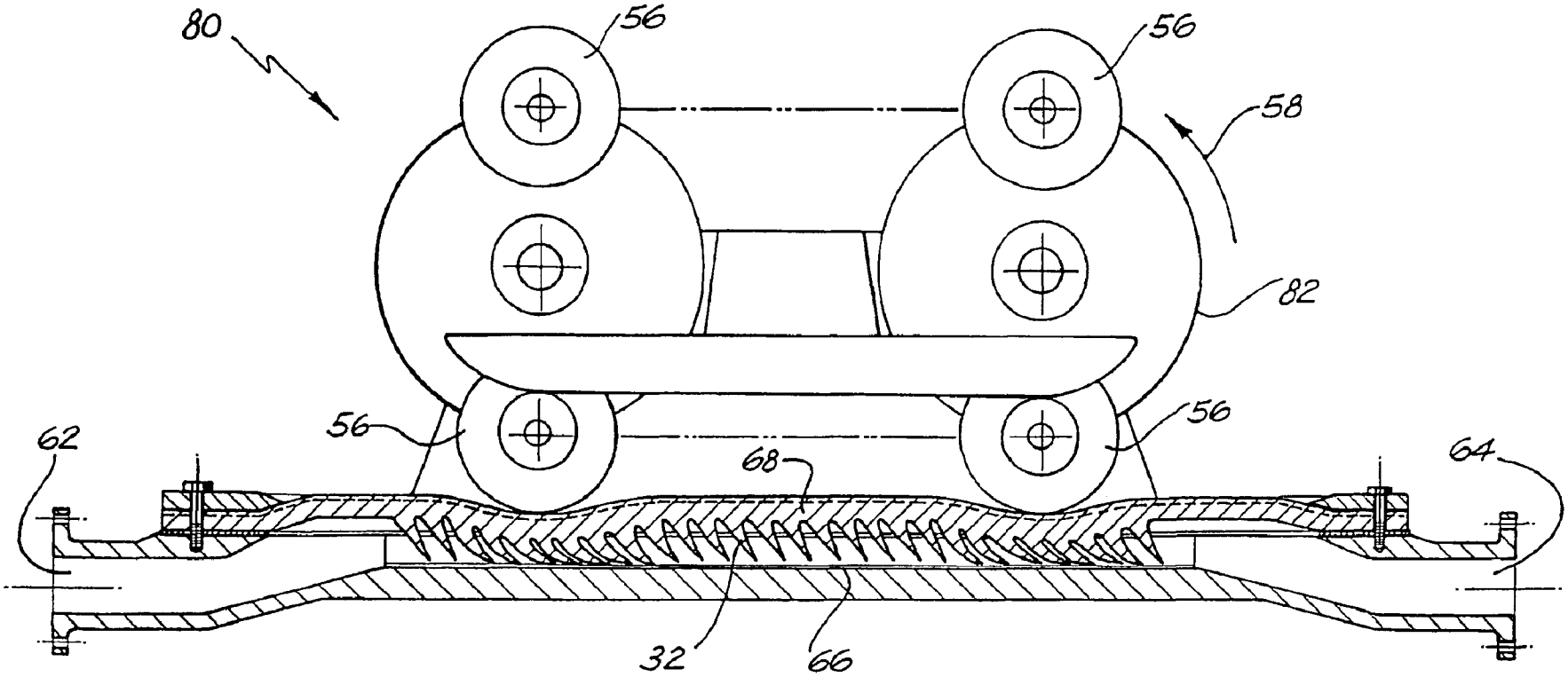
FIG. 7 is a schematic cross sectional side view of a fourth embodiment of a peristaltic pump according to the invention.

FIG. 7 shows a fourth embodiment of peristaltic pump 80, again with common features to earlier embodiments identified using common reference numerals. The pump 80 is similar to the pump 60 shown in FIG. 6 except the rollers 56 travel along an obround track 82.

Figure 8:
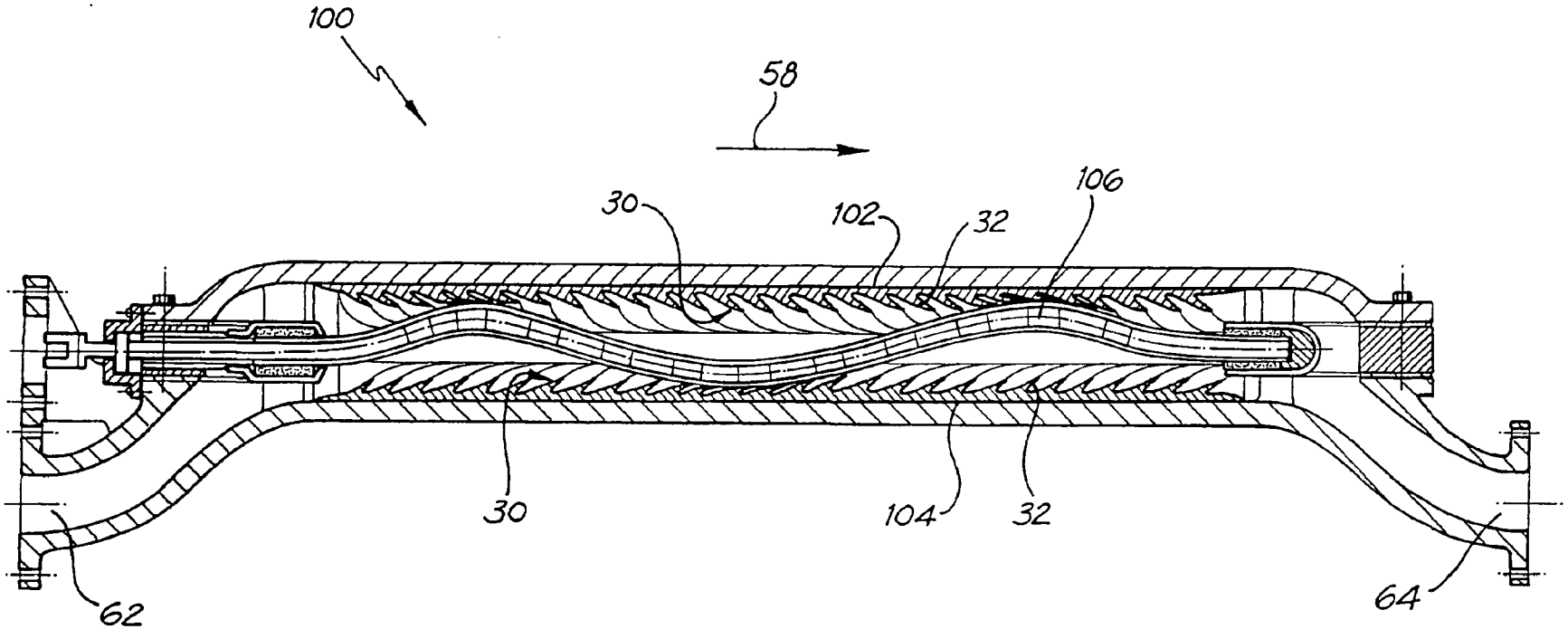
FIG. 8 is a schematic cross sectional side view of a first embodiment of a travelling wave diaphragm pump according to the invention.

FIG. 8 shows a first embodiment of a travelling wave diaphragm pump 100. Like reference numerals are again used to indicate feature common to earlier embodiments. The pump 100 functions in the manner of embodiments disclosed in the Applicant's International PCT Patent Application No. PCT/AU00/01563. However, in the pump 100, the inner opposed (first and second) pumping chamber surfaces 102, 104 include the surface arrangement 30 previously described. Further, the amplitude of the generally sinusoidal internal diaphragm 106 has been reduced such that the ridges 32 of the pumping chamber surfaces 102 and 104 deform into sealing engagement with the diaphragm 106, thereby reducing frictional losses and power consumption, as previously described.

Figure 9:
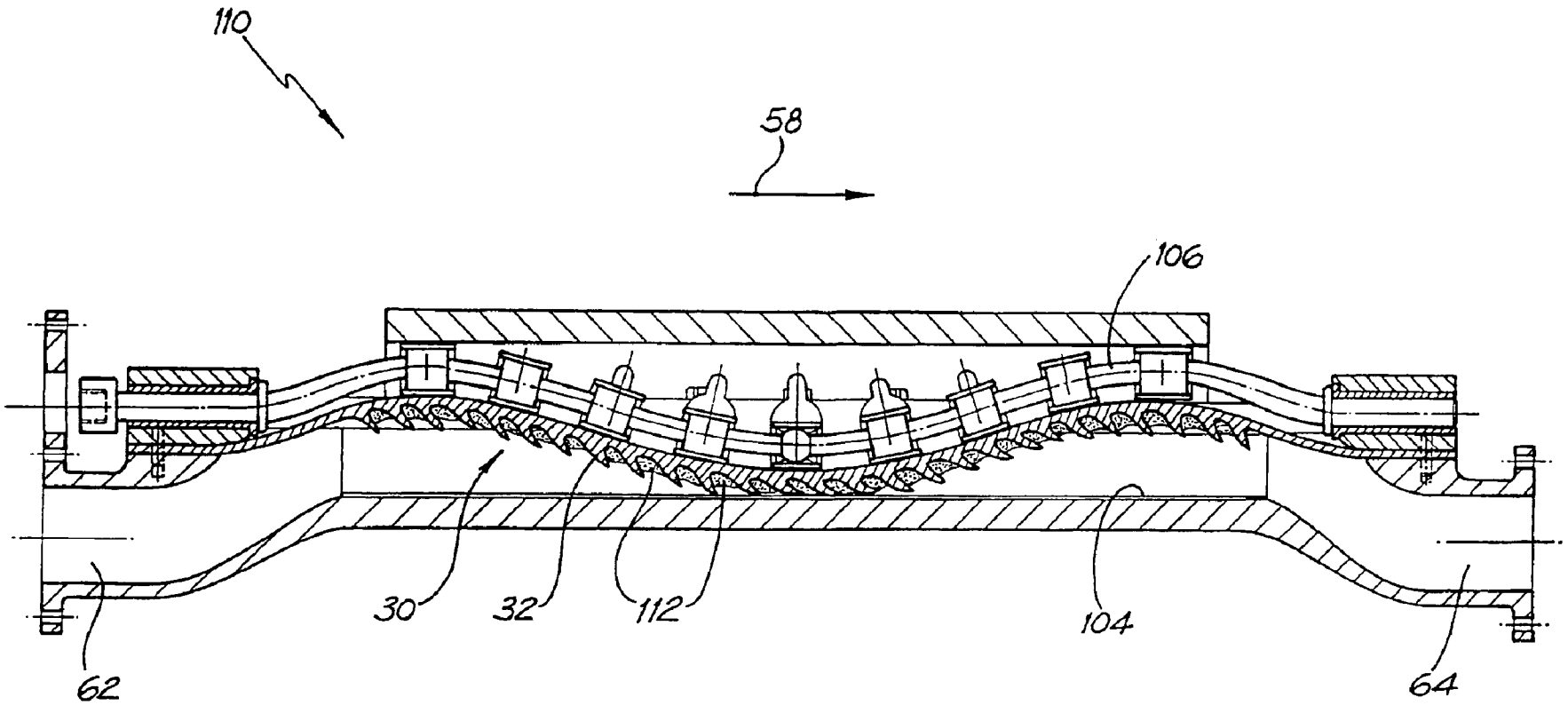
FIG. 9 is a schematic cross sectional side view of a second embodiment of a travelling wave diaphragm pump according to the invention.

FIG. 9 shows a second embodiment of travelling wave diaphragm pump 110 having common features to earlier embodiments denoted with like reference numerals. The pump 110 differs from that shown in FIG. 8 in that it is configured with the surface arrangement 30 being applied to only one side of the flexible diaphragm 106 and the material being pumped is only passed between that side of the diaphragm 106 and the adjacent pumping chamber surface 104. Also, the valleys 38 between the ridges 32 are partially filled by deformable sponge material 112, to ensure any solids suspended in the material being pumped can not become lodged in the valleys 38.

Figure 10:
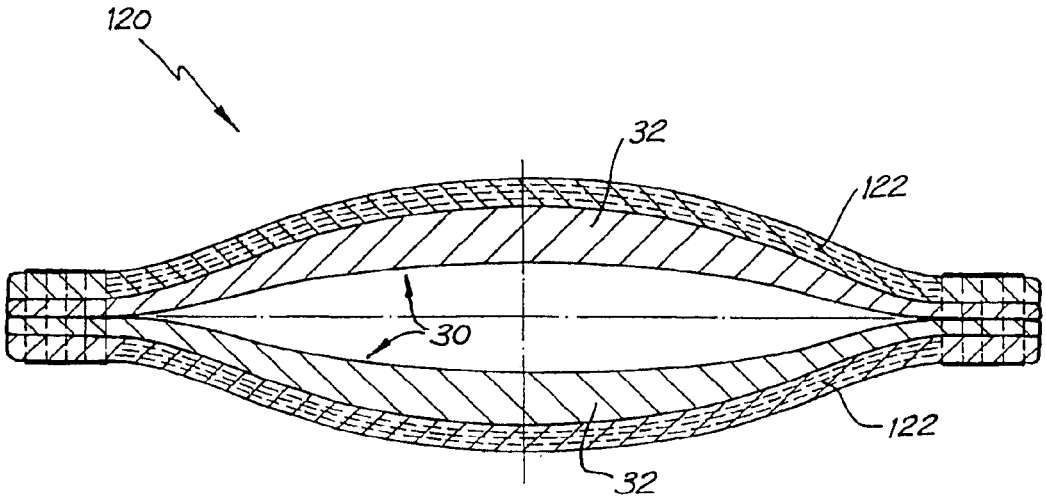
FIG. 10 is a schematic cross sectional end view of a pump tube for a fifth embodiment of a peristaltic pump according to the invention.
Figure 11:
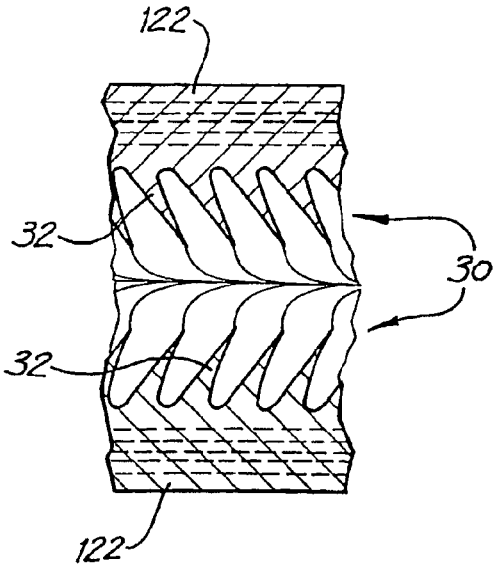
FIG. 11 is an enlarged cross sectional detail side view of the tube shown in FIG. 10 in the absence of a localised force.
Figure 12:
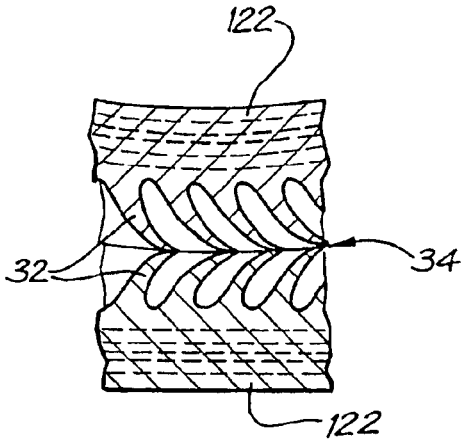
FIG. 12 is an enlarged schematic cross sectional detail side view of the tube shown in FIG. 10 in the presence of a localised force.

FIGS. 10 to 12 show an embodiment of a flexible pump tube 120 for a peristaltic pump in which the surface arrangement 30 has been applied to both inner pumping chamber surfaces. The tube 120 is formed by stitching two flexible sheets 122 together at their longitudinal edges. FIG. 11 is a segment in side cross section in the absence of a localised force and FIG. 12 shows a similar segment in the presence of a localised force in which the peaks 34 of the opposed ridges 32 are forced into sealing against each other to form the aforementioned non-return valves.

Figure 13:
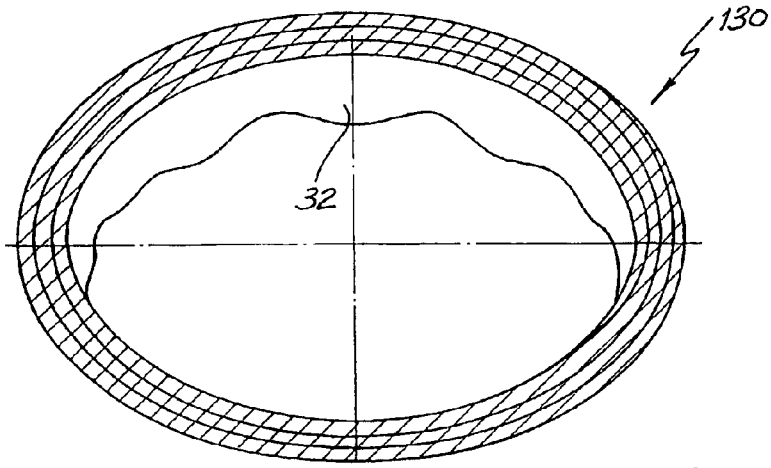
FIG. 13 is a schematic cross sectional end view of a pump tube for a sixth embodiment of peristaltic pump according to the invention in the absence of localised force.
Figure 14:
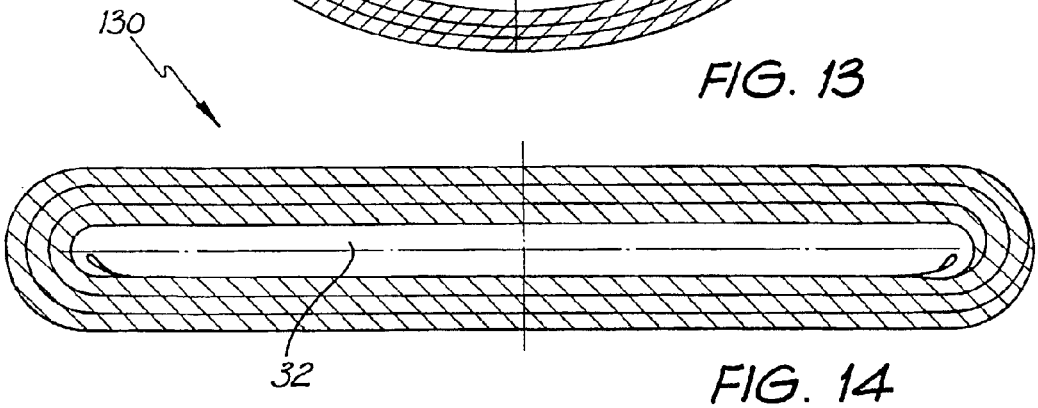
FIG. 14 is a schematic cross sectional end view of the pump tube shown in FIG. 13 in the presence of a localised force.
Figure 15:
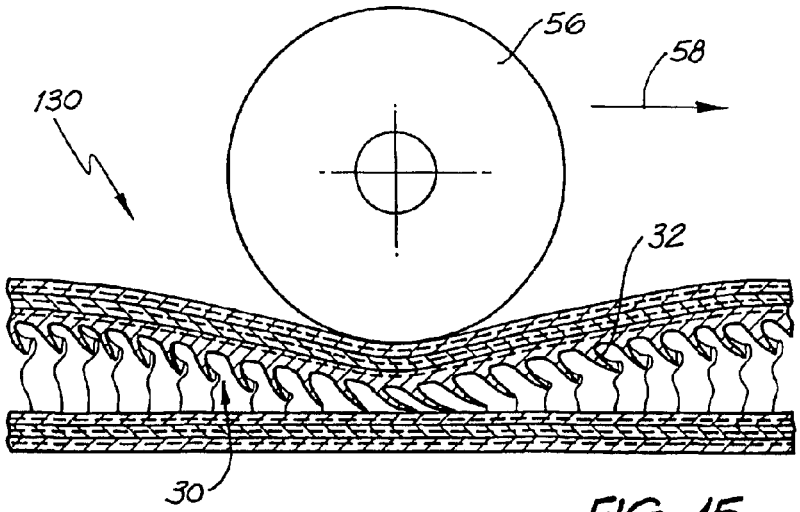
FIG. 15 is a partial schematic cross sectional side view of the tube shown in FIG. 14.

FIGS. 13 to 15 show another embodiment of flexible pump tube 130 formed from a unitary flexible hollow casing,and in which the surface arrangement 30 is applied to only one of the pumping chamber surfaces. FIG. 13 is a cross sectional end view of the pump tube 130 in the absence of a localized force. FIG. 14 is a cross sectional end view of the pump tube 130 in the presence of a localized force. FIG. 15 is a cross sectional side view of the pump tube 130 in the presence of a localized force introduced by the roller 56 acting towards the rigid surface 52. The ridges 32 take on an irregular buckled or deformed shape in the absence of a localised force and a regular shape when stretched during the presence of a localised force.

Figure 16:
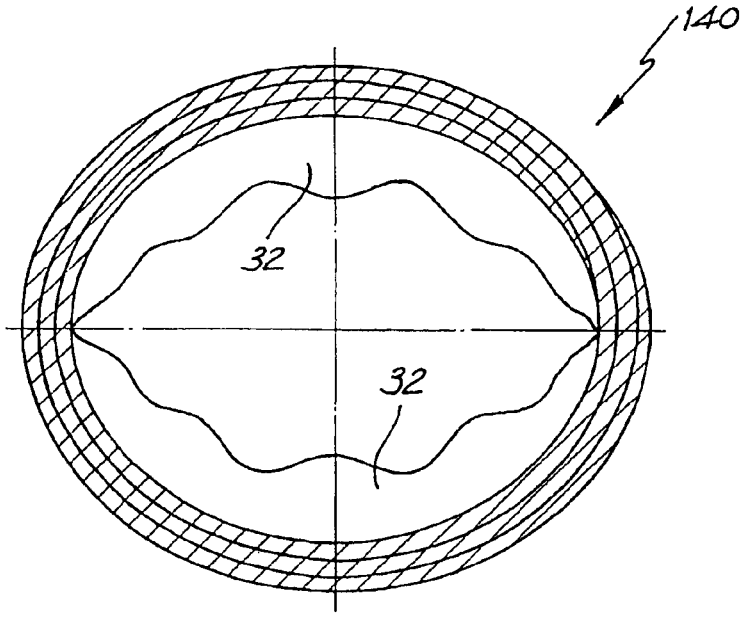
FIG. 16 is a schematic cross sectional end view of a pump tube for a seventh embodiment of a peristaltic pump according to the invention in the absence of localised force.
Figure 17:
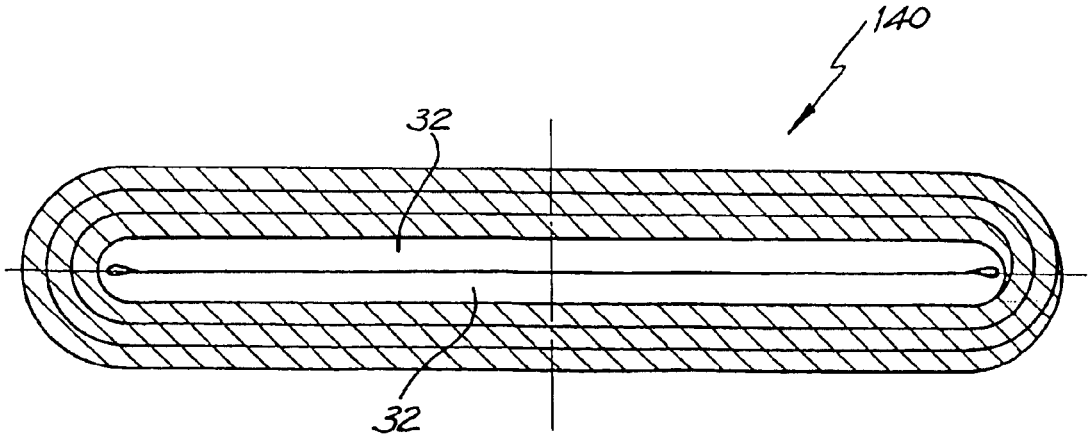
FIG. 17 is a schematic cross sectional end view of the pump tube shown in FIG. 16 in the presence of a localised force.
Figure 18:
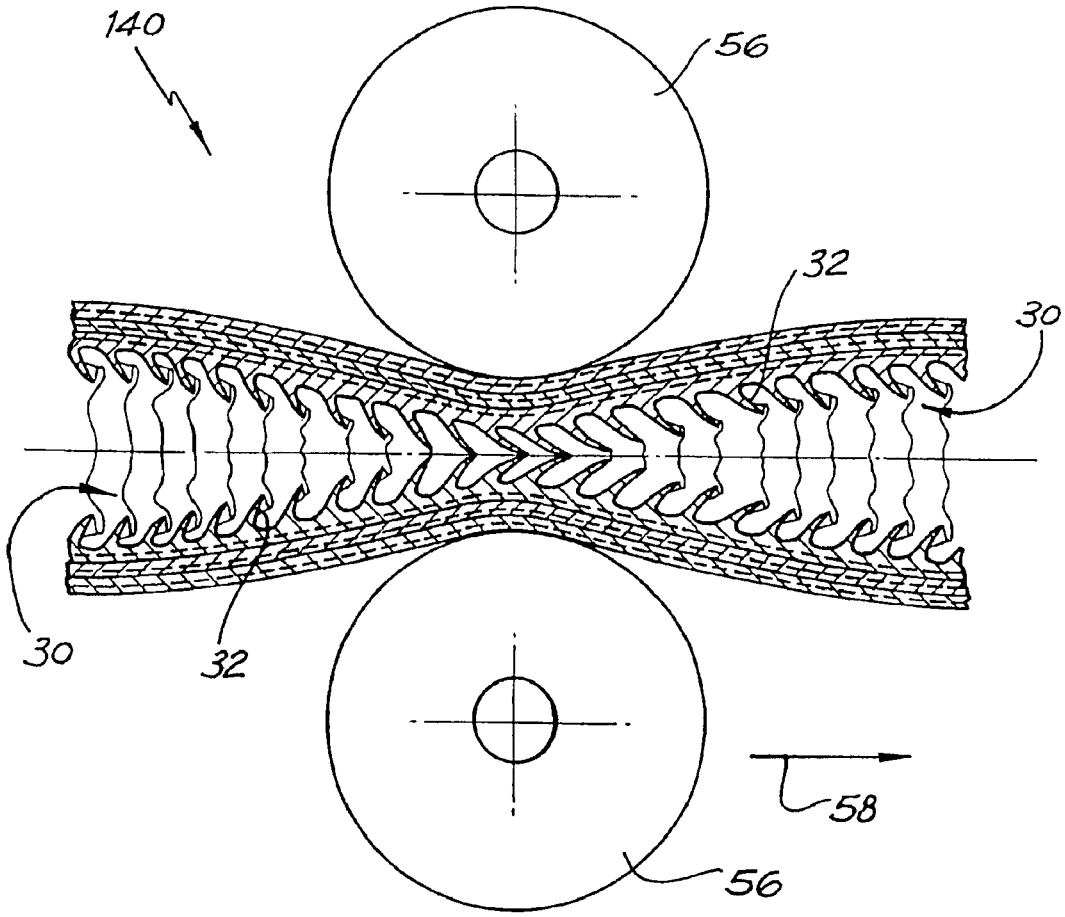
FIG. 18 is a partial schematic cross sectional side view of the pump shown in FIG. 17.

FIGS. 16 to 18 are similar views to FIGS. 13 to 15 respectively of another embodiment of flexible pump tube 140 that has the surface arrangement on both the pumping chamber surfaces, and in which the localised force is applied by a pair of opposed rollers 56.

As explained above, the advantage provided by the embodiments of the invention is reduced mechanical forces in creating a travelling seal in travelling volume pumps. This reduces friction and power consumption and also improves the longevity of mechanical components.

Although the invention has been described with reference to the preferred embodiments, it will be appreciated by those skilled in the art that the invention can be embodied in many other forms. For example, the filtering membrane 42 can be applied to any of the other embodiments shown in other figures.

What is claimed is:

1. A traveling volume pump, comprising:

a pumping chamber defined between first and second opposed pumping chamber surfaces, the pumping chamber surfaces extending from an inlet to an outlet of the pump in a pumping direction;

a plurality of flexible first ridges on the first pumping chamber surface and inclined in the pumping direction, said ridges extending across the first pumping chamber surface in a direction generally transverse to the pumping direction; and wherein said first ridges have distal peaks adapted to abut and substantially seal against the second pumping surface in the presence of a localized force displacing one of the first and second pumping chamber surfaces towards the other of said first and second pumping chamber surfaces.

2. The pump of claim 1 further including a plurality of flexible second ridges on said second pumping chamber surface and inclined in the pumping direction, said second ridges extending across the second pumping chamber surface in a direction generally transverse to the pumping direction.

3. The pump of claim 2 wherein said second ridges are adapted to abut and substantially seal against the first ridges in the presence of said localized force.

4. The pump of claim 1 wherein one of the first and second pumping chamber surfaces is relatively rigid and the other of said first and second pumping chamber surfaces is relatively flexible.

5. The pump of claim 4 wherein said localized force is applied to the relatively flexible pumping chamber surface.

6. The pump of claim 1 wherein both of said first and second pumping chamber surfaces are flexible.

7. The pump of claim 1 wherein said first ridges have a saw tooth profile and cross section.

8. The pump of claim 7 wherein said first ridges have sharp peaks, substantially straight sides, and are connected by curved valleys.

9. The pump of claim 8 further comprising a filtering membrane, and wherein at least some of said peaks of said first ridges are bridged by said filtering membrane.

10. The pump of claim 8 wherein at least some of said valleys of said first ridges are at least partially filled by a deformable sponge material.

11. The pump of claim 1 wherein said first and second pumping chamber surfaces have edges extending generally parallel to the pumping direction that are substantially sealingly connected to each other.

12. The pump of claim 11 wherein said edges are connected by stitching,gluing, or welding.

13. The pump of claim 1 wherein said first and second pumping chamber surfaces are respective portions of a unitary, flexible, hollow casing surrounding said pumping chamber.

14. The pump of claim 1 wherein said pump is a peristaltic pump.

15. The pump of claim 1 further comprising means to move an application point of said localized force in the pumping direction.

16. An assembly, comprising:

a first pumping chamber wall having a first interior surface;

a second pumping chamber wall having a second interior surface;

a pumping chamber defined between said first and second interior surfaces and having an inlet, and outlet, and a pumping direction oriented from said inlet toward said outlet;

a plurality of flexible first ridges disposed on said first interior surface and inclined in said pumping direction, said first ridges extending across said first interior surface in a direction generally transverse to said pumping direction; and said first ridges adapted to abut and substantially seal against said second interior surface in the presence of a localized force displacing one of the first and second pumping chamber surfaces towards the other of said first and second pumping chamber surfaces wherein application of a localized force displacing one of the first and second pumping chamber surfaces towards the other of said first and second pumping chamber surfaces causes said first ridges to abut and substantially seal against said second interior surface.

17. The assembly of claims 16 wherein a fluid disposed in said pumping chamber is pumped in said pumping direction when said localized force is moved in said pumping direction and substantially sealed against backflow by said first ridges.

18. The pump of claim 16 further including a plurality of flexible second ridges disposed on said second interior surface and inclined in said pumping direction, said second ridges extending across said second interior surface in a direction generally transverse to said pumping direction.

19. The pump of claim 18 wherein said second ridges are adapted to abut and substantially seal against said first ridges in the presence of said localized force.

20. The pump of claim 16 wherein one of said first and second pumping chamber walls is relatively rigid and the other of said first and second pumping chamber wall is relatively flexible.

* * * * *